United States Patent [19]

Eisman

[11] Patent Number: 4,877,178

[45] Date of Patent: Oct. 31, 1989

[54] PAPERBOARD FOLDABLE CARTON

[75] Inventor: Larry Eisman, Elkins Park, Pa.

[73] Assignee: Dopaco, Inc., Downingtown, Pa.

[21] Appl. No.: 347,040

[22] Filed: May 4, 1989

[51] Int. Cl.[4] ..... B65D 43/08

[52] U.S. Cl. ..... 229/114; 229/125.28; 229/125.29; 229/148; 229/150

[58] Field of Search ..... 229/114, 128, 148, 150, 229/149, 902, 906, 125.26, 125.28, 125.29

[56] References Cited

U.S. PATENT DOCUMENTS

| | | | |
|---|---|---|---|
| 2,154,218 | 4/1939 | Seifer . | |
| 2,544,565 | 3/1951 | Phillips . | |
| 2,551,324 | 5/1951 | Frieders et al. . | |
| 2,565,288 | 8/1951 | Worfford . | |
| 2,654,526 | 10/1953 | McReary . | |
| 2,839,236 | 6/1958 | Dunning . | |
| 2,889,103 | 6/1959 | Kuchenbecker | 229/149 |
| 2,900,122 | 8/1959 | Steiner | 229/149 |
| 2,922,565 | 1/1960 | Roderick et al. | 229/148 |
| 3,019,958 | 2/1962 | Asman et al. . | |
| 3,095,137 | 6/1963 | Reynolds . | |
| 3,105,626 | 10/1963 | McCormick et al. . | |
| 3,166,230 | 1/1965 | Engstrom . | |
| 3,410,475 | 11/1968 | Wagner | 229/125.29 |
| 3,684,159 | 8/1972 | Wolfe . | |
| 3,809,305 | 5/1974 | Persson . | |
| 3,942,712 | 3/1976 | Bundy et al. . | |
| 4,018,378 | 4/1977 | Persson . | |
| 4,098,453 | 7/1978 | Arneson . | |
| 4,232,816 | 11/1980 | Johnson et al. . | |
| 4,266,713 | 5/1981 | Maroszek . | |
| 4,298,133 | 11/1981 | Davis . | |
| 4,339,068 | 7/1982 | Brauner . | |
| 4,360,147 | 11/1982 | Brauner . | |
| 4,570,845 | 2/1986 | Hall . | |
| 4,657,176 | 4/1987 | Matsubara | 229/125.28 |
| 4,714,190 | 12/1987 | Morrocco . | |
| 4,763,832 | 8/1988 | Forbes, Jr. . | |
| 4,809,908 | 3/1989 | Keefe et al. | 229/150 |

*Primary Examiner*—Gary Elkins

*Attorney, Agent, or Firm*—Dennison, Meserole, Pollack & Scheiner

[57] ABSTRACT

A carton having a tray and cover locked in closed position by means of a pair of detents extending forwardly and above the front wall of the tray. The detents are of double thickness being formed by overlapped extensions of the glue flaps and side walls of the tray. A pair of slots in the cover receives the detents in a closed position to lock the cover to the tray.

6 Claims, 4 Drawing Sheets

PAPERBOARD FOLDABLE CARTON

BACKGROUND OF THE INVENTION

This invention relates to paperboard cartons designed primarily for use in the fast food industry, although they may be readily used to package other items. Cartons manufactured for this service are sold in vast numbers to dispense hamburgers, sandwiches and other hot and cold foods. These cartons must possess a number of basic features. They must be nestable in the open position to reduce bulk while waiting to be put into service. They must possess the requisite strength to resist distortion due to the rapid handling motion of the server in taking an open carton, filling it with a food item, closing it to a locked position, and then serving it to a customer. They also must be capable of being reopened and reclosed without damage. This latter feature is important in the event the customer belatedly requests some special service.

In addition to the above, cost plays an important role. The paperboard must be of the highest quality to be used for food service. The material is quite expensive and requires the carton to be designed to yield minimum scrap when stamping the blank forming the carton. Many carton designs, while meeting the basic features discussed above, are so wasteful of paperboard as to be economically noncompetitive.

A large number of foldable paperboard cartons have been invented, as typified by U.S. Pat. Nos. 4,570,845, issued Feb. 18, 1986, to Charles J. Hall; 4,232,816, issued Nov. 11, 1980 to Fred J. Johnson et al; and 2,544,565, issued Mar. 6, 1951 to Lawrence H. Phillips.

The patent to Hall shows a foldable paperboard carton having laterally extending locking tabs in the cover which are inserted in slots provided in the tray side panels. To engage or disengage the lock, the cover must be laterally deformed to pull the tabs away from the slots. Johnson et al show a foldable paperboard carton having a single tab mounted on the front panel of the cover. This tab locks into a single latching slot mounted in the upper portion of the tray front wall. Phillips shows a foldable paperboard carton with forwardly directed tabs on a lower portion of the front panel of the tray. The cover has slots which lock onto the tabs in the closed position.

While the above representative patents do teach foldable paperboard cartons with reusable front locks, the prior art does not teach a carton design of sturdy construction with minimal waste of material such as found in this invention.

SUMMARY OF THE INVENTION

The overall object of the present invention is to improve upon the prior art paperboard foldable cartons by providing a stronger locking mechanism, by increasing the resistance to deformation, and by reducing the amount of paperboard waste.

It is a specific object of the invention to provide a double thickness locking detent projecting forwardly of the tray front panel at an upper region thereof.

It is another object of the invention to provide a clamshell carton with vertical extensions on the corner glue flaps of the tray rear panel to prevent the cover from inadvertently moving forward to disengage the lock.

It is another object of the invention to form the carton from a blank stamped out of sheet or strip paperboard stock with minimum waste.

It is yet another object of the invention to apply the inventive features to both a clamshell carton and a box carton with separable tray and cover.

DESCRIPTION OF THE PREFERRED EMBODIMENTS

Figure 1:
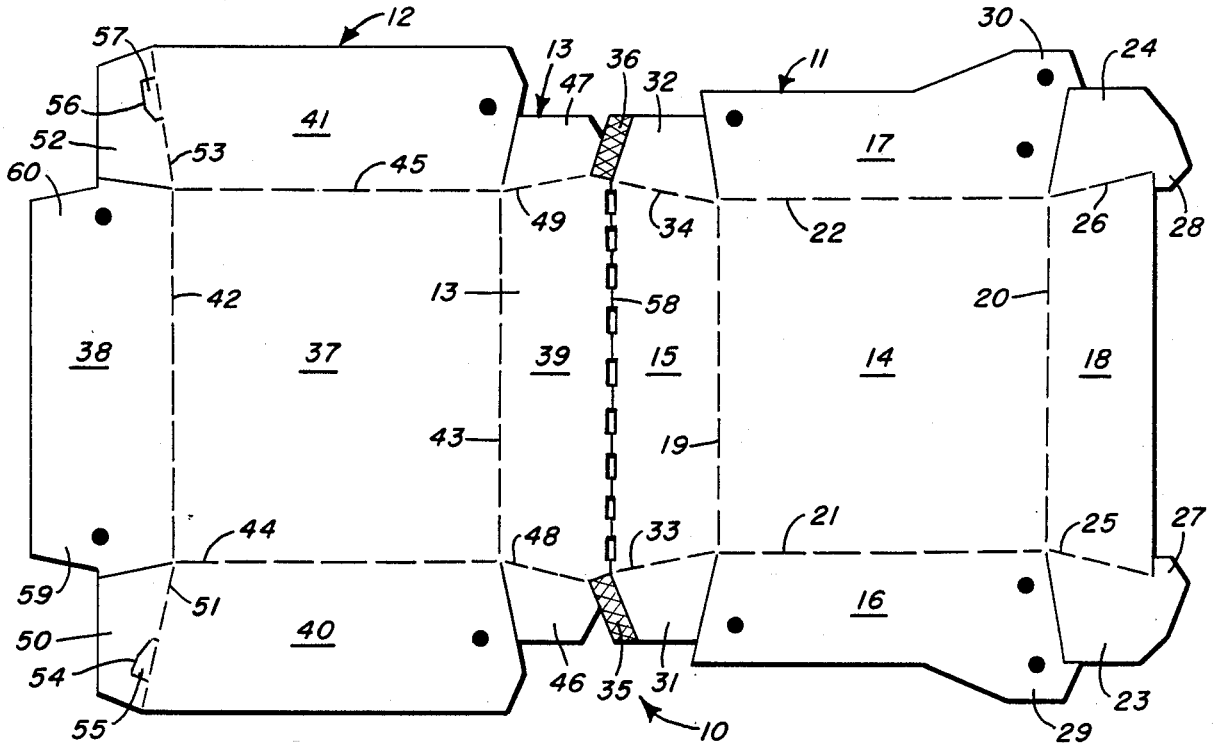
FIG. 1 is a top plan view of a stamped and scored paperboard blank for forming the clamshell embodiment of the invention illustrated in FIGS. 2–4.

Referring now in general to the drawings and in particular to FIGS. 1–4, the novel clamshell carton of this invention is formed of a unitary blank 10 comprising a bottom tray-forming section 11, a top cover-forming section 12, and a connecting section 13. Fold lines are shown as dashed lines while cut lines are shown as heavy solid lines.

Tray section 11 comprises a bottom rectangular panel 14, a rear wall panel 15, similar side walls 16, 17, and a front wall 18. Rear and front walls 15, 18 are both trapezoidal in shape with their minor bases connected to panel 14 along fold lines 19, 20, respectively. Side walls 16 and 17 are connected to panel 14 along fold lines 21, 22, respectively. A pair of front wall glue flaps 23, 24 are connected to opposite ends of front wall 18 along fold lines 25, 26, respectively. A pair of locking detents 27, 28 are formed in glue flaps 23, 24, respectively, to project forwardly of front wall 18.

A pair of locking detents 29, 30 are formed on side walls 16, 17, respectively, to extend outwardly thereof. As will be explained in connection with FIG. 2, detents 29, 30 and 27, 28 overlap each other in the assembled position to form sturdy, double thickness locking detents. It should be noted that with the exception of outwardly extending detents 29, 30, side walls 16, 17 are of trapezoidal shape similar to rear and front walls 15, 18.

A pair of rear wall glue flaps 31, 32 are connected to opposite ends of rear wall 15 along fold lines 33, 34, respectively. Extending rearwardly and integral with glue flaps 31, 32 are unglued trapezoidal sections 35 and 36, shown cross-hatched. Sections 35 and 36 extend vertically above side walls 16 and 17 in the assembled position to act as a stop to inhibit movement of the top cover.

The cover 12 comprises a top central panel 37 connected to front cover wall 38, rear cover wall 39, and side walls 40, 41 by means of fold lines 42, 43, 44, 45, respectively. The use of "front" and "rear38 is based on the location in the assembled carton. A pair of cover rear wall glue flaps 46, 47 are connected to opposite sides of rear wall 39 along fold lines 48, 49 respectively. A glue flap 50 is connected to side wall 40 along fold line 51. A similar glue flap 52 is connected to side wall 41 along fold line 53.

A detent receiving slot 54 is cut into a small section of glue flap 50. The slot is formed by notching out a section along the solid cut line forming a tab 55 whih can pivot about a small section of fold line 51. Tab 55 may be left in place or entirely removed. A similar detent receiving slot 56 is cut into glue flap 52 to form pivoted tab 57.

A slotted fold line 58 forms a hinge between rear walls 15 and 39 of the tray and cover to form a hinged clamshell carton.

The black circular dots situated at various locations on blank 10 represent glue deposits which are spread and join the various parts together, however, other joining means such as heat sealing may also be employed.

Figure 2:
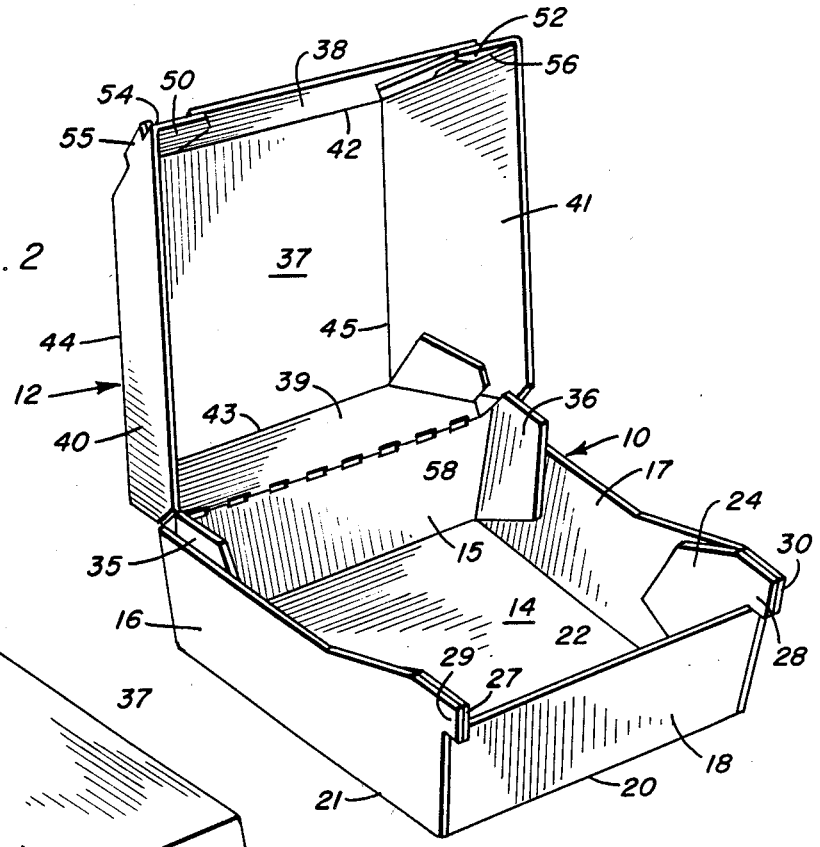
FIG. 2 is a perspective view showing the blank of FIG. 1 assembled and in the open position.

The assembled carton is shown in FIG. 2 in an open position. Note the open truncated pyramid shape of the tray and cover formed by the trapezoidal-shaped side walls. This construction enables easy nesting of a stack of cartons. The detents 27, 29 and 28, 30 can be seen projecting forwardly of front tray panel 18 on an upper portion thereof. Having the detents at this location increases the volume of the container in comparison with prior art constructions. Also, the double thickness detent construction increases the resistance of the carton to deformation when filled cartons are stacked. Detent receiving slots 54 and 56 can be seen in an upper portion of front wall 38.

Trapezoidal sections 35 and 36 extend vertically above the tray rear wall 15 to abut cover rear wall 39 when the cover is in the closed position. The vertical extensions in this position act as stops to prevent the cover from moving forward with respect to the tray to release the locking mechanism.

Figure 3:
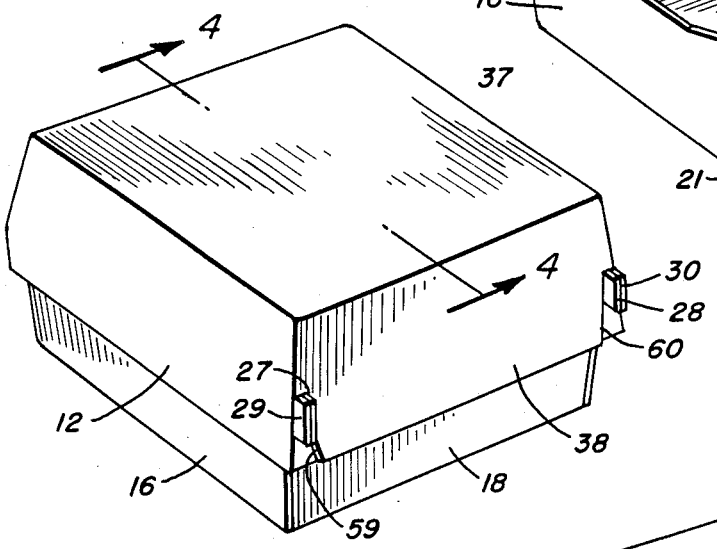
FIG. 3 is a perspective view showing the carton of FIG. 2 in a closed position.

FIG. 3 shows the carton in a closed position. The truncated pyramidal-shaped top cover extends over the smaller truncated pyramidal-shaped tray to form a closed carton. The cover is locked to the tray when detents 27, 29 and 28, 30 snap into slots 54, 56 as the cover is closed. Tabs 55 and 57 are deflected to one side by the locking action. Front cover wall 38 is relieved at 59 and 60 to uncover the detent receiving slots. The cover can be unlocked by squeezing the sides of the bottom panel to clear the detents.

Figure 4:
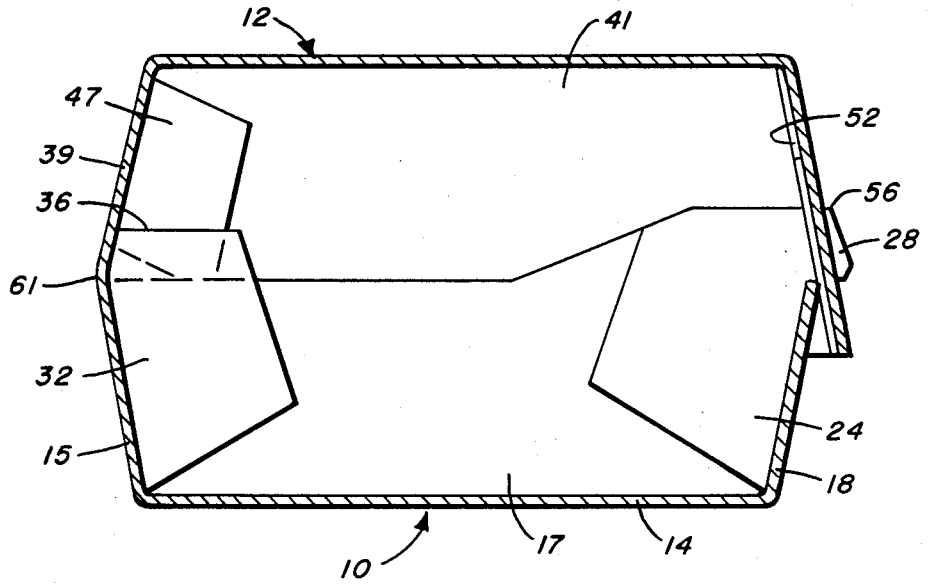
FIG. 4 is a cross-sectional view taken along the line 4—4 of FIG. 3.

FIG. 4 is a view from the inside of the closed container showing the relationships between the detents and vertical stops and the carton cover. The rear side 61 of trapezoidal section 36 is shown abutting cover wall 39 to prevent forward movement of the cover. Detent 28 which is part of glue flap 24 is shown projecting through slot 56 forming a locking mechanism.

FIGS. 5–10 show a second embodiment of the invention wherein the novel double detent and capturing slot of the first embodiment is used to form a separable box container of larger proportions.

Figure 5:
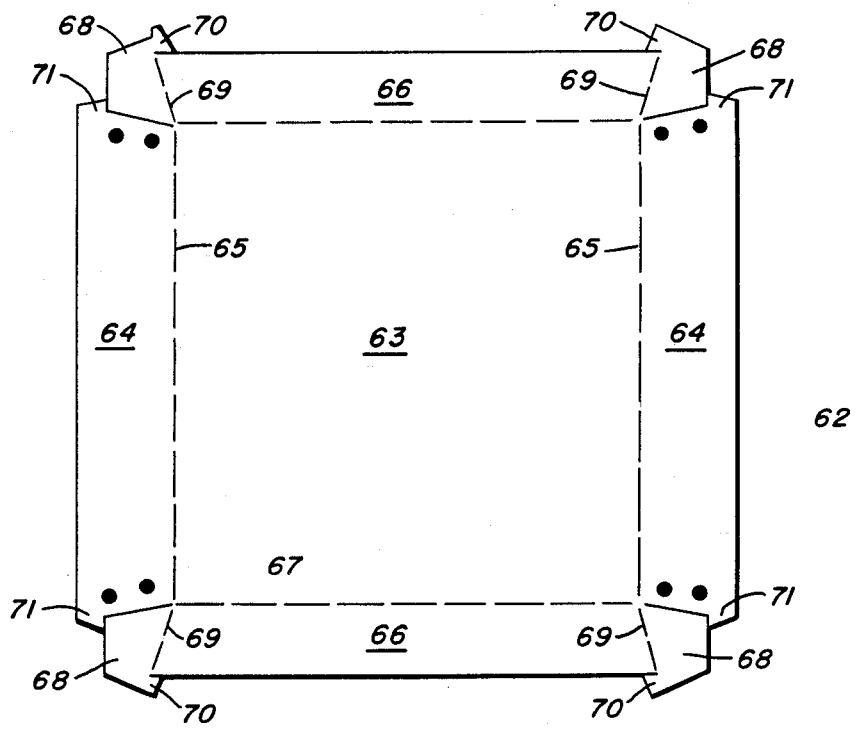
FIG. 5 is a top plan view of the stamped and scored paperboard blank for forming the tray portion of the separable box embodiment of the invention.

Referring first to FIG. 5, the tray portion is formed of a unitary paperboard blank 62 comprising a bottom trayforming section 63, a first pair of opposed similar tray side walls 64 joined to the bottom section 63 along fold lines 65, and a second pair of tray side walls 66 joined to section 63 along fold lines 67. The first pair of side walls 64 being of a greater depth than the second pair 66.

A pair of similar glue flaps 68 are connected to opposite ends of each side wall 66 along fold lines 69. A locking detent 70 is formed in each glue flap 68 to extend outwardly of its associated side wall 66.

A locking detent 71 is formed on end portions of each first side wall 64 to extend outwardly thereof. As will be explained in connection with FIG. 6, detents 70 and 71 overlap each other in the assembled position to form sturdy, double thickness locking tabs and maximizing vertical compression strength of the assembled carton.

As in the first embodiment, the black circular dots on blank 62 represent glue deposits which are spread and join the various parts together in an assembled relationship.

Figure 6:
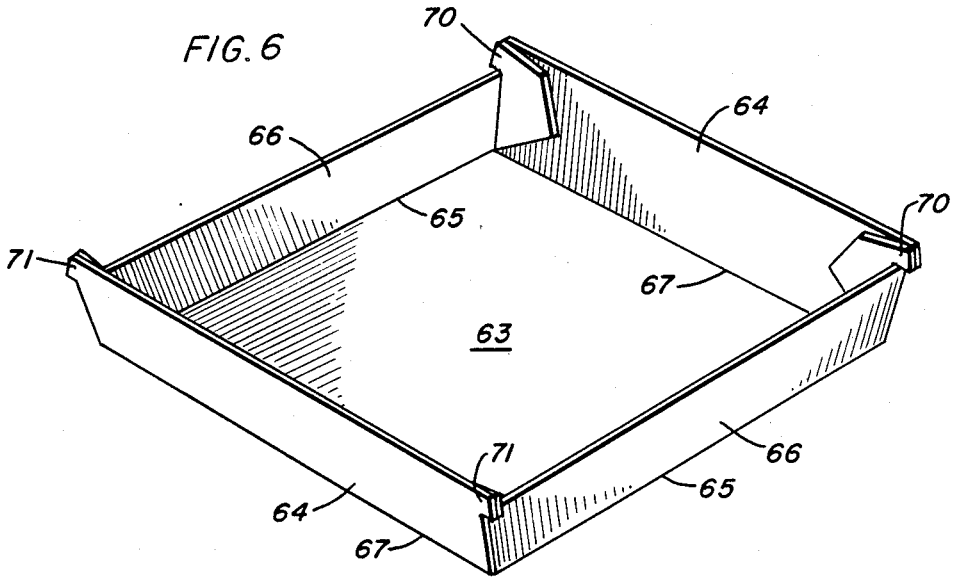
FIG. 6 is a perspective view showing the tray blank of FIG. 5 in an assembled position.

The assembled tray portion is shown in FIG. 6. As in the first embodiment, the trapezoidal-shaped side walls form an upwardly flared open structure conducive to easy nesting of tray sections. The detents 70, 71 can be seen joined in overlapping relationship to extend above the second side walls 66. An overlapped detent 70, 71 is provided at each corner of the tray.

Figure 7:
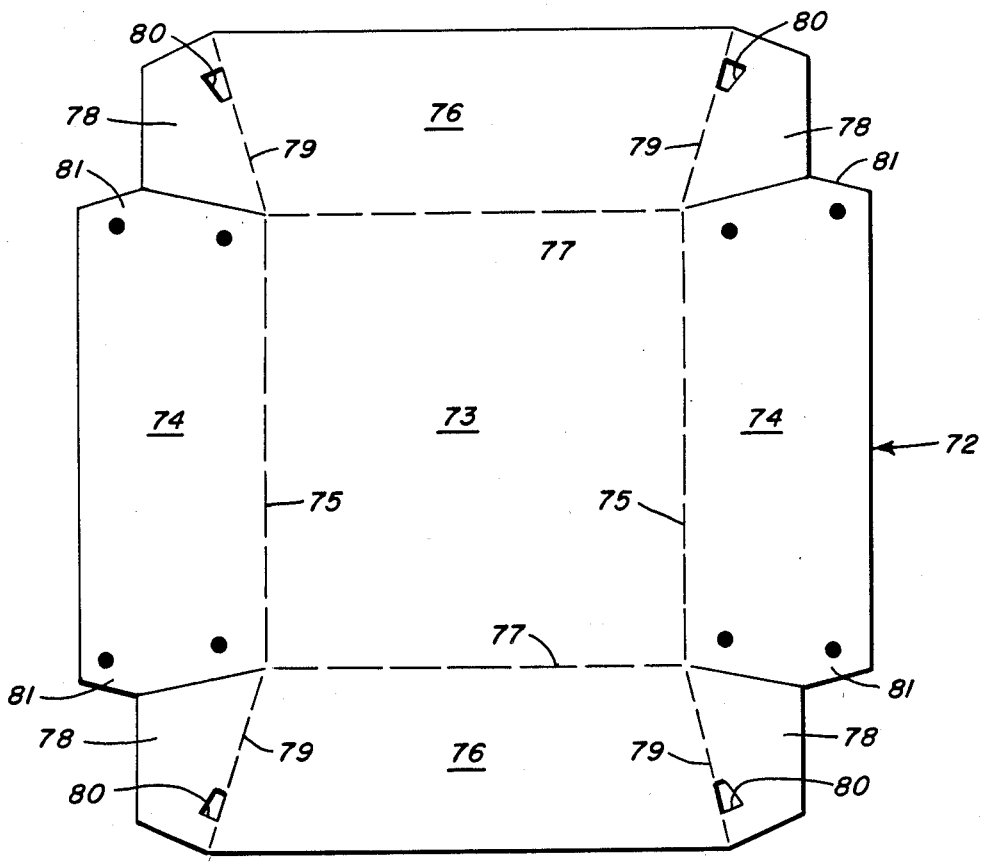
FIG. 7 is a top plan view of the stamped and scored blank for forming the cover portion for the FIG. 5 tray.

Referring to FIG. 7, the cover portion is formed of a unitary paperboard blank 72 comprising a central cover panel 73, a first pair of opposed similar cover side walls 74 joined to the cover panel 73 along fold lines 75, and a second pair of cover side walls 76 joined to panel 73 along fold lines 77.

A pair of similar cover glue flaps 78 are connected to opposite ends of each cover side wall 76 along fold lines 79. Each glue flap 78 is provided with a trapezoidal opening 80 which extends from the fold line 79 part way across the flap. Although the openings 80 are here shown as trapezoidal in shape, they may also be formed by tabs similar to those illustrated at 55 and 57 in FIG. 1. The openings 80 cooperate with relieved portions 81 on side walls 74 to form locking slots which receive the detents 70, 71 when the cover blank 72 is assembled and placed in position on the tray.

The black circular dots on blank 72 represent glue deposits as previously described in connection with the tray blank 62.

Figure 8:
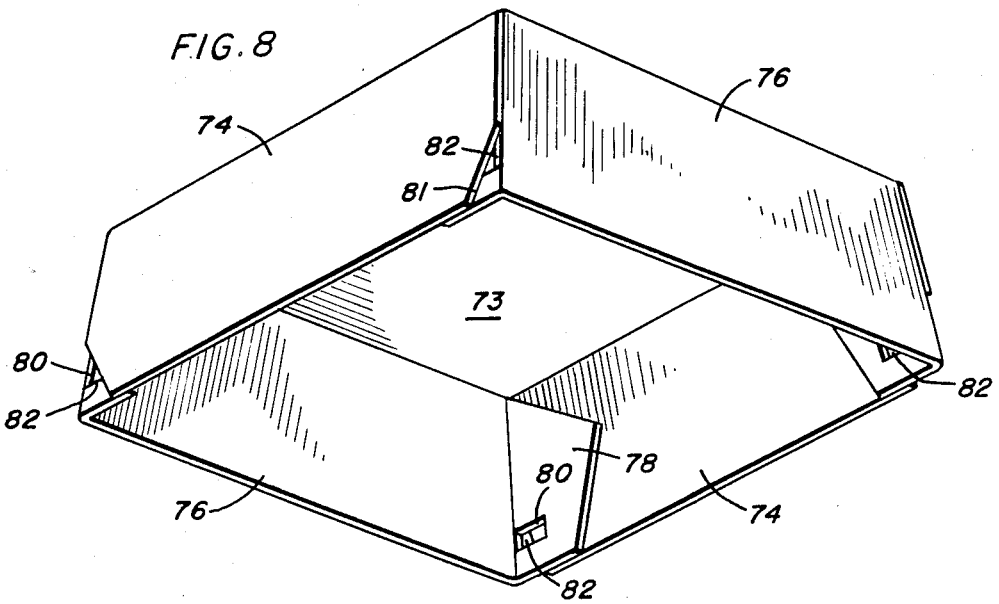
FIG. 8 is a perspective view showing the cover blank of FIG. 6 in an assembled position.

The cover blank 72 is shown in assembled position in FIG. 8. As in the tray embodiment, the trapezoidal-shaped side walls form a flared open structure conducive to easy nesting of the cover sections. The detent receiving slits 82 formed by openings 80 and relieved portions 81 are shown at each upper corner of the cover.

Figure 9:
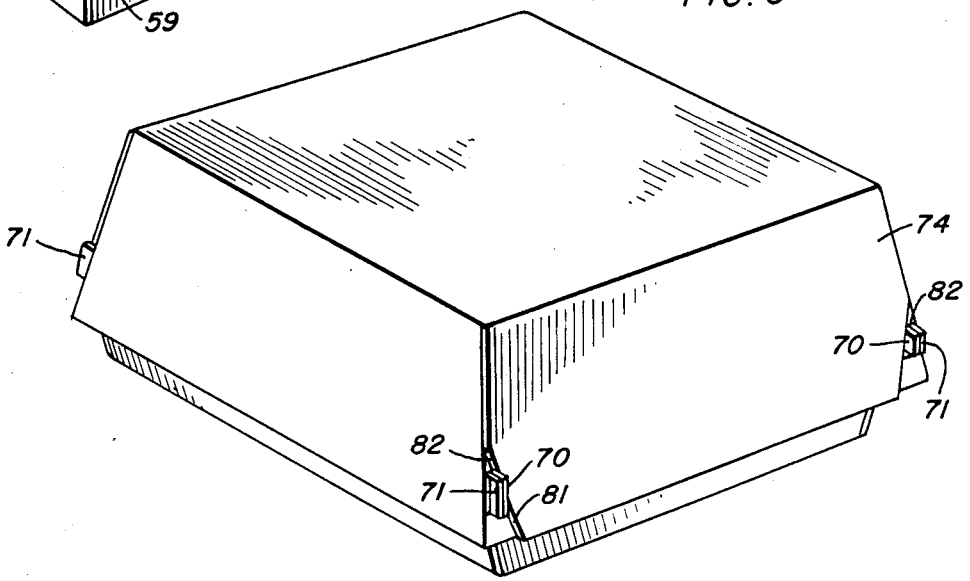
FIG. 9 is a perspective view showing the tray and cover of FIGS. 6 and 8 in an assembled closed position.

FIG. 9 shows the cover mounted on the tray in locked position. The double detents 70, 71 can be seen projecting through slits 82 for locking the cover to the tray. The cover can be removed and reclosed without damaging the detents. Side walls 74 can be pulled outwardly and lifted over the detents.

It should be noted that in both embodiments, the forming blanks are of a generally full square or rectangular configuration. Deep grooves and intricate shapes are avoided. Such a configuration generates less scrap.

It is not intended to limit the present invention to the details of illustration or terms of description of the preferred embodiments shown above. It will be appreciated by those skilled in the art that various modifications and alterations therein may be made within the scope of the present invention.

I claim:

1. A carton formed from a unitary blank of cut and foldable paperboard comprising:

a tray, a cover fitting over said tray, and a fold line hinge connecting said tray and cover, said tray comprising:

a bottom panel, two side walls, a rear wall and a front wall, said front wall having two glue flaps, each glue flap being adhered to one of said side walls, each glue flap having a detent in an upper portion thereof extending forwardly and above said front wall, each side wall having a detent in an upper portion thereof extending forwardly and above said front wall, each glue flap detent and each side wall detent being in overlapped joined relation to form a pair of double thickness detents, said cover comprising:

a top panel, two side walls, a rear wall and a front wall, said front wall having a slot at each end portion thereof, said slots receiving said pair of detents when said cover is closed to lock said cover to said tray.

2. A carton according to claim 1 wherein said cover rear wall is joined to said tray rear wall by said fold line hinge, said tray rear wall having two glue flaps, each tray rear wall glue flap being adhered to one of said tray side walls, each tray rear wall glue flap having an upper portion extending above said tray side walls, said upper portions abutting the cover rear wall when the cover is in closed position to prevent forward movement of said cover to release said detents.

3. A carton according to claim 2 wherein said upper portion is trapezoidal in shape.

4. A carton formed of a separable tray and cover, said tray comprising:

a bottom panel, a first pair of opposed similar tray side walls, a second pair of opposed similar tray side walls, said first pair of side walls being of greater depth than said second pair, said second pair of side walls having a glue flap at each end portion thereof adhered to an adjacent end portion of said first side walls, each glue flap having a detent in an upper portion thereof extending outwardly and above said second side walls, each said first side wall having a detent extending outwardly and above said second side walls, said glue flap detents and said first side wall detents being in overlapped joined relation to form two pairs of double thickness detents, said cover comprising:

a top panel, a first pair of opposed similar cover side walls, a second pair of opposed similar cover side walls, said first pair of cover side walls having slots at each end portion thereof, said slots receiving said two pairs of detents when said cover is placed on said tray to lock said cover to said tray.

5. A carton according to claim 4 wherein a glue flap is provided at each end portion of said first pair of cover side walls, an opening being provided in each glue flap, a relieved portion being provided at each end of said second pair of cover side walls, said openings and relieved portions overlapping each other to form said slots.

6. A carton according to claim 5 wherein said opening is trapezoidal in shape.

* * * * *